United States Patent [19]

Mustelier

[11] 4,019,745

[45] Apr. 26, 1977

[54] ELECTRICAL CHESS GAME

[76] Inventor: Enrique Mustelier, 307 Bird Road, Coral Gables, Fla. 33134

[22] Filed: Oct. 29, 1975

[21] Appl. No.: 626,977

[52] U.S. Cl. ..... 273/136 A; 340/323 R

[51] Int. Cl.[2] ..... A63F 3/02

[58] Field of Search ..... 35/8 R, 22 R, 9 B, 6, 35/9 A; 235/92 GA; 273/1 E, 85 R, 136 A, 137, DIG. 28; 340/323 R, 323 B, 337

[56] References Cited

UNITED STATES PATENTS

| | | | |
|---|---|---|---|
| 3,503,296 | 3/1970 | Schmoyer et al. | 35/6 |
| 3,654,392 | 4/1972 | Beinhocker | 340/323 |
| 3,843,132 | 10/1974 | Ferguson | 273/136 A |
| 3,888,491 | 6/1975 | Bernard et al. | 273/136 A |
| 3,895,807 | 7/1975 | Friedman | 340/323 X |
| 3,939,579 | 2/1976 | Andrews et al. | 35/9 A |

OTHER PUBLICATIONS

Popular Science; "Games Computers Play;" vol. 197, No. 4; Oct. 1970; p. 44.

*Primary Examiner*—Richard C. Pinkham
*Assistant Examiner*—Vance Y. Hum
*Attorney, Agent, or Firm*—Jack D. Slobod

[57] ABSTRACT

A chess game apparatus utilizing a square matrix of sixty four optical display cells for displaying plural chessman states includes a keyboard having keys corresponding to ranks and files in the matrix for addressing and entering a digital memory which drives the cells. Each cell is in the form of an array of light emitting diodes which are selectively energized in response to the memory via a decoder and diode matrix for creating light patterns corresponding to each of the six chessman symbols. Thus, moves or changes of the chess positions indicated on the cell matrix are commanded via the keyboard. A memory for previous moves is also fed by the keyboard to provide for resetting the states of the cell matrix to a previous chess position.

1 Claim, 5 Drawing Figures

ELECTRICAL CHESS GAME

FIELD OF THE INVENTION

The present invention relates generally to electrically operated games. In its particular aspects, the present invention relates to an electrically operated chessboard formed of optical display elements for displaying chess symbols in response to electrical signals from a digital memory entered by a keyboard.

BACKGROUND OF THE INVENTION

The game of chess, in view of recent publicity, is undergoing a renaissance and many new players are attracted to the game. One problem with playing the game is that the loose pieces either may be lost or may be jostled on the game board during play disturbing the chess game position portrayed. While electronic technology has advanced a great deal enabling such things as electronic calculators and numerical displays therefor to be produced inexpensively, such technology has not been utilized to my knowledge to produce an electronic chess game which would optically portray a chess position to avoid the use of loose pieces.

OBJECTS OF THE INVENTION

It is an object of the present invention to provide a chess game apparatus utilizing an electronically controlled optical display for portraying a chess game position.

It is a further object of the present invention to provide a chess game apparatus which is simple to use, inexpensive and portable.

It is yet another object of the present invention to provide a chess game apparatus which can produce a portrayal of a previous chess position.

SUMMARY OF THE INVENTION

Briefly, the aforementioned and other objects of the present invention are satisfied by providing a chess game apparatus in a pocket calculator type case having an optical display and a keyboard for influencing the display. The display is formed of a chessboard matrix of optical cells, each cell being capable of displaying any of plural light patterns corresponding to the six different types of chessmen of each color. The cell matrix is fed digitally from a memory organized to store the chessman state of each cell in the chessboard. Moves or changes of position of any piece are made via the keyboard by addressing the memory with store instructions via keys provided for each file and each rank in the chessboard.

To enable a previous chess position to be displayed on the cell matrix, a memory for the last few moves is fed by the keyboard. The previous instructions stored in this move memory are utilized to undo changes of position made in the position memory.

Other objects, features and advantages of the present invention will become apparent upon perusal of the following detailed description of the preferred embodiment thereof when taken in conjunction with the appended drawing wherein.

DETAILED DESCRIPTION

Figure 1:
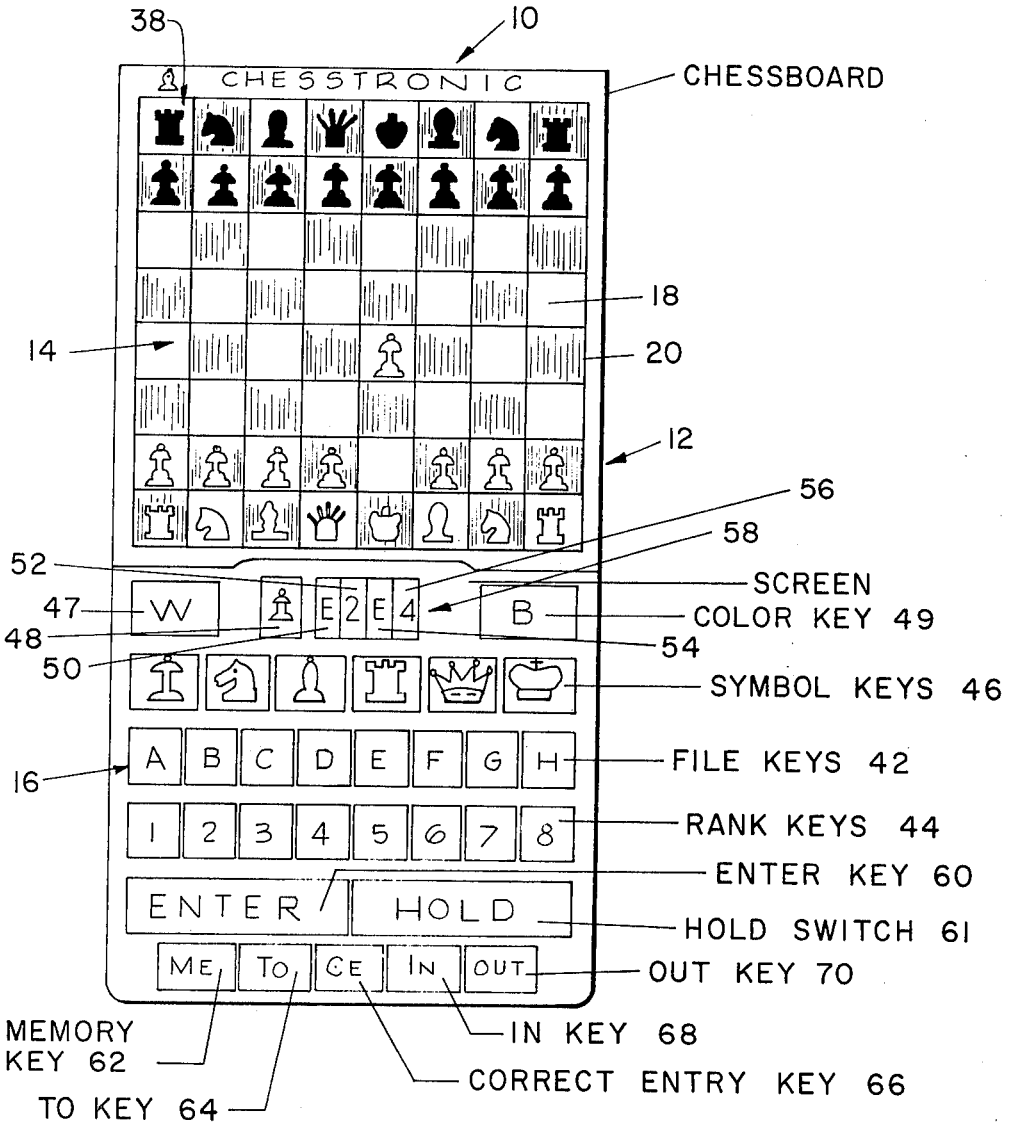
FIG. 1 is a top view of the electric chess game of the present invention including a matrix of squares.
Figure 2:
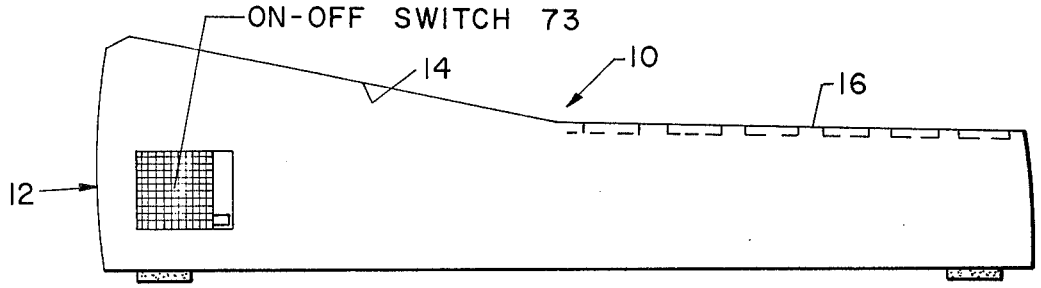
FIG. 2 is a side elevation view of FIG. 1.

Referring to FIGS. 1 and 2 the electric chess board 10 of the present invention comprises a portable battery powered unit in a pocket sized generally rectangular case 12. The top face of case 12 is split into an upper half which is generally a square surface 14 angled for viewing and flat lower half forming a keyboard 16. Surface 14 contains a square matrix array of sixty four alternating transparent square sheets 18 and smokey colored translucent square sheets 20 arranged in the form of a chessboard.

Figure 3:
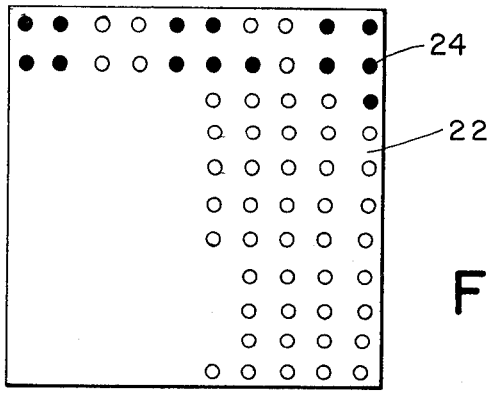
FIG. 3 is a front view enlargement of the square in the lower left hand corner of the matrix in FIG. 1.
Figure 4:
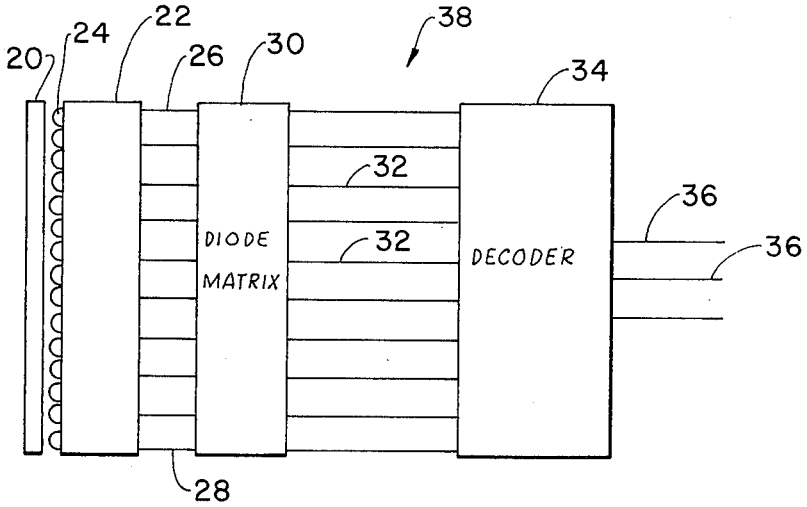
FIG. 4 is a side view of FIG. 3.

Now referring also to FIGS. 3 and 4, behind each of the sheets or plates 18 and 20 there is positioned an optical display cell 22 comprising a rectangular array of light emitting diodes 24 of sufficient number, such as ten by ten, to form resolveable light patterns therewith in the shape of each of the usual chessman symbols, which are visible through the sheets 18 and 20.

Referring specifically to FIG. 3, which portrays the light pattern of a white rook, the darkened dots signify those light emitting diodes 24 (LED'S) which are lit, while those dots having undarkened centers correspond to unlit LED'S. To form a black rook, the light pattern of FIG. 3 is simply inverted, that is the LED'S lit therein will not be lit, and those not lit therein will be lit. It should be appreciated that by the same technique light patterns for the queen, king, knight, bishop and pawn of either black or white color are easily displayed by the array of LED'S 24 in FIG. 3 in addition to the rook pattern. With the additional restriction that when a square of checkerboard surface 14 is unoccupied by a piece all the LED'S are not to be lit, it should be apparent that each of the cells 22 must be capable of displaying thirteen states, corresponding to the six chessmen types of each color plus the unoccupied state. These thirteen states may be kept track of with only four bits of digital code.

Referring to FIG. 4, one wire 26 from each LED, along with a common wire 28 is brought out the back of optical display cell 22 and fed to the output of a diode matrix 30. Diode matrix 30 has thirteen input lines 32 for receiving an electrical signal on any one line at a time corresponding to the thirteen states of cell 22. In response to which one of lines 32 is energized, the appropriate lines 26 are energized to light the LED'S 24 corresponding to the desired symbol.

For converting the aforementioned "one of thirteen" input to decoder matrix 30 to a format compatible with a digital memory, a decoder 34 is utilized driving lines 32 and receiving four lines 36 which are sufficient to specify a four bit digital code. The entire unit 38 in FIG. 4 which converts from a four bit digital input on lines 36 to a light pattern on cells 22 shall be further termed herein a display element.

Figure 5:
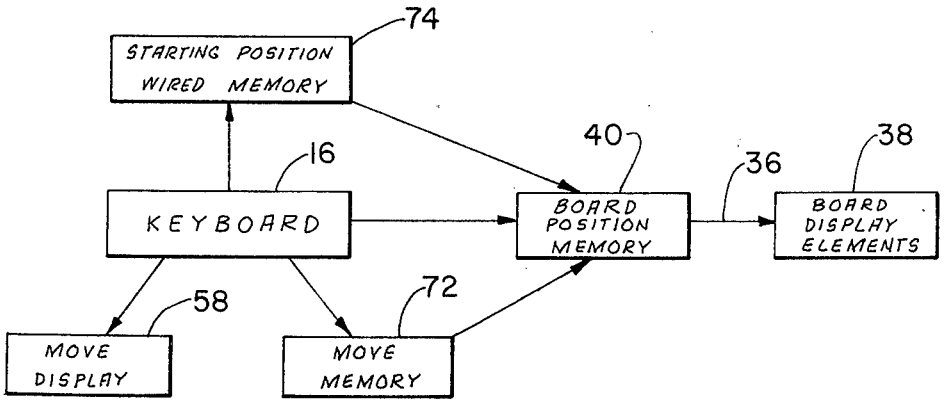
FIG. 5 is an overall schematic of the electric chess game of the present invention.

Referring to FIG. 5, the display elements 38 are driven by a digital memory 40 which is organized in four bit memory cells which are addressable by the rank and file (or row and column) location of display elements 38 on chessboard face 14.

For changing chess positions such as moving a chesspiece from one square to another, the keyboard 16 is provided feeding the memory 40. Referring also to FIG. 1, keyboard 16 includes a row of eight file keys 42, lettered A through H for indicating the file or column on chessboard face 14 which is referred to in left to right order. Below file keys 42, there is a corresponding row of eight rank keys 44 numbered 1 through 8 for indicating the rank or row on chessboard face 14 which is referred to in top to bottom order. Above the file keys 42, there is also a row of six symbol keys 46 each marked with a different one of the symbols of the six types of chessmen. Above symbol keys 46 there is a key 47 for black and a key 49 for white for indicating the color of the chessman symbol referred to.

Centrally above symbol keys 46 and between keys 47 and 49 there are five side by side display cells denominated consecutively in left to right order by the numerals 48, 50, 52, 54 and 56 which comprise a move instruction display 58. Cell 48 is a display element 38 organized for displaying chessman symbols. Cells 50 and 54, are similar to elements 38, but are organized for displaying the rank letters A through H, while cells 52 and 56 are numerical displays for the rank numbers 1 through 8.

Below rank keys 44 there is disposed an "ENTER" key 60, and a "HOLD" key 61 in side by side relationship and below those keys there is further disposed a row of five side by side keys: a "Memory" key 62, a "To" key 64, a "Correct Entry" key 66, an "In" key 68 and an "Out" key 70.

A move or change of position is made in the following manner which will illustrate the use of most of the keys in keyboard 16. To move the white king's pawn from king two to king four, first the white key 47 is depressed. Next the pawn symbol on keys 46 is depressed. This action lights display cell 48 in the pattern of a white pawn. Next the "E" key in file keys 42 is pressed to indicate the king's file and lighting cell 50 in the pattern of the letter E. Next the 2 key in rank keys 44 is depressed, lighting the cell 52 in the pattern of the number 2. Thus far the piece to be moved and its location has been specified. Next, to indicate that what follows is the position to which the piece is to be moved, the To key 64 is depressed. Thereafter the king's file, fourth position is indicated by depressing the E rank key, lighting display cell 54 in that pattern, and the 4 file key to light display cell 56 in that pattern. Then the contents of display 58 is examined and if correct the "Enter" key 60 is depressed which transfers the displayed instruction to memory 40. In memory 40, the contents of the memory cell for the E2 position is erased, corresponding to the digital code for unoccupied, and the code formerly stored in the E2 position is transferred to the E4 memory position. As a result, board display element 38 reflect the new board position.

If the instruction displayed on display 58 is not correct it is erased and cleared by depressing the "Correct Entry" key 66 permitting the desired instruction or move to be then set in correctly.

The "In" and "Out" keys 68 and 70 are utilized to remove pieces from the board and to place pieces on the board rather than moving pieces. For example, by depressing White, Pawn, E, 1, Out, a white pawn is removed from E1. This is simply an erase instruction to erase the E1 memory cell. Then by depressing White, Queen, E, 1, Out, a Queen is placed on square E1. This is simply a store instruction to memory 40, commanding the memory to substitute White Queen for the contents of memory cell E1. It should be apparent that the "IN" and "OUT" keys 68 and 70 are useful for corrections, for performing queening operations and for setting up the chessboard to a desired position.

Keyboard 16 also feeds an instruction or more memory 72 which stores the last twelve instructions in bump down store fashion. By depressing memory key 62, the last instruction stored in move memory 72 is fed to the board position memory 40 in reverse order to undo the last move and restore the chessboard to the previous position. Since the last six instructions are stored in memory 72, the game can be continually backtracked up to a position played six moves by each player ago by pressing key 62 up to six times.

On the side of case 12 there is a slideable on-off switch 73 for turning off the unit 10. When the switch is placed to the ON position a keyboard instruction is automatically generated which loads memory 40 serially or in parallel from a permanently wired memory 74 having the usual starting position of the chessboard stored therein. To avoid this resetting to initial position and to provide for storing a game position in unit 10 when it is turned off, memory 40 may be configured as a plated wire memory. The hold button 60 which is configured to maintain a depressed position until it is depressed again serves the function of a memory protection key of the type utilized in computers employing a plated wire or other semi-permanent read-write memory.

Having described the invention in great detail it should be apparent that numerous modifications, additions and omissions to the details thereof are possible within the spirit and scope of the invention. Accordingly, the following claims define the scope of the invention.

What is claimed is:

1. A chess game apparatus comprising: a chessboard matrix of ranks and files of electrically operable optical display cells; each of said cells being configured to selectively display at least twelve states in the form of symbols generally in the shape of the six types of chessmen of each of two colors in response to a coded digital input signal; board position memory means coupled to said cell matrix and organized for storing and supplying said digital input signal for each cell corresponding to the state of each cell; input and keyboard means coupled to said board position memory means for commanding a desired change of position of said cell matrix by designating the rank and file of any of said cells, the chessmen symbol currently displayed at said designated cell, and the rank and file of the cell to which the symbol at said designated cell is to be moved, said keyboard means comprising: a set of eight rank keys in one to one correspondence with the six types of chessmen symbols; and a set of two color keys in one to one correspondence with said two colors of chessmen; said chess game apparatus further comprising a move memory means fed by said keyboard means for storing a sequence of the last previous changes of position of said cell matrix; said keyboard means including a memory key coupled for enabling transfer of information from said move memory means to said board memory means to enable sequentially undoing moves in response to each actuation of said memory key.

* * * * *